United States Patent [19]

Craig et al.

[11] Patent Number: 4,926,507

[45] Date of Patent: May 22, 1990

[54] ADJUSTABLE DRAIN CLOSURE

[75] Inventors: Burnie M. Craig, Laguna Beach; Roy K. Fujitaki, Altadena, both of Calif.

[73] Assignee: American Brass and Aluminum Foundry Co., Inc., Los Angeles, Calif.

[21] Appl. No.: 390,025

[22] Filed: Aug. 9, 1989

[51] Int. Cl.[5] ..... A47K 1/14; E03C 1/26

[52] U.S. Cl. ..... 4/295; 4/286; 4/204

[58] Field of Search ..... 4/286, 287, 288, 295, 4/204, 661; 138/89

[56] References Cited

U.S. PATENT DOCUMENTS

| | | | |
|---|---|---|---|
| 3,366,980 | 2/1968 | Petursson et al. | 4/295 |
| 4,007,500 | 2/1977 | Thompson et al. | 4/295 |
| 4,339,832 | 7/1982 | Cuschera | 4/286 |
| 4,369,531 | 1/1983 | Swanson | 4/286 X |
| 4,420,844 | 12/1983 | Puckett et al. | 4/286 X |
| 4,720,877 | 1/1988 | Watts | 4/286 |

*Primary Examiner*—Henry K. Artis

*Attorney, Agent, or Firm*—William W. Haefliger

[57] ABSTRACT

A drain closure comprises a drain stopper having a downwardly projecting sleeve, an upwardly extending post loosely received in the sleeve, and structure carrying the post, the sleeve having at least one opening through the side thereof, and a spring carried by the sleeve and having an arm received in that opening to frictionally engage the post, whereby the sleeve, spring and stopper are adjustably movable up and down relative to the post, against frictional force exerted by the spring arm engaging the post as the arm slides relative to the post.

13 Claims, 2 Drawing Sheets

ADJUSTABLE DRAIN CLOSURE

BACKGROUND OF THE INVENTION

This invention relates generally to drain closures, and more particularly to a simple, effective, and low-cost drain closure incorporating a stopper that has selectable open, as well as closed, positions relative to a closure body.

While drain closures are well known, there is continuing need for simple, effective and low-cost closures, also characterized by reliability and long life. They should also be capable of easy disassembly, as for replacement of stopper structure which may incorporate an elastomer seal.

SUMMARY OF THE INVENTION

It is a major object of the invention to provide an improved drain closure providing the needed advantages. Basically, the closure comprises (a) a drain stopper having a downwardly projecting sleeve, (b) an upwardly extending post loosely received in said sleeve, and means carrying the post, (c) the sleeve having at least one opening through the side of the sleeve, (d) and a U-shaped spring carried by the sleeve and having an arm received in said opening to frictionally engage the post, (e) whereby the sleeve, spring and stopper are adjustably movable up and down relative to the post, against frictional force exerted by the spring arm engaging the post as the arm slides relative to the post.

It is another object to provide post extent that locally projects into said opening, to be engaged by the arm; to provide two openings in the sleeve, at opposite sides thereof, to receive two spring arms, to provide sleeve defined upper and lower walls between which the spring arms are confined, at said openings; and to provide sleeve defined flats facing but spaced from the arms, the flats extending in planes parallel to an axis defined by the post.

It is another object to provide in the above sleeve and U-shaped spring environment a tubular drain body, which opens upwardly, the post projecting above the base of said body, the post and body being coaxial. Typically the stopper has a removable tubular cap, and the post projects into said cap when the stopper is closed downwardly, relative to said body. The post typically has a lower end with removable threaded connection to drain body structure; and the upper end of the post may carry a flange to limit upward movement of the stopper, relative to the post, as will be seen.

These and other objects and advantages of the invention, as well as the details of an illustrative embodiment, will be more fully understood from the following specification and drawings, in which:

DRAWING DESCRIPTION

DETAILED DESCRIPTION

Figure 1:
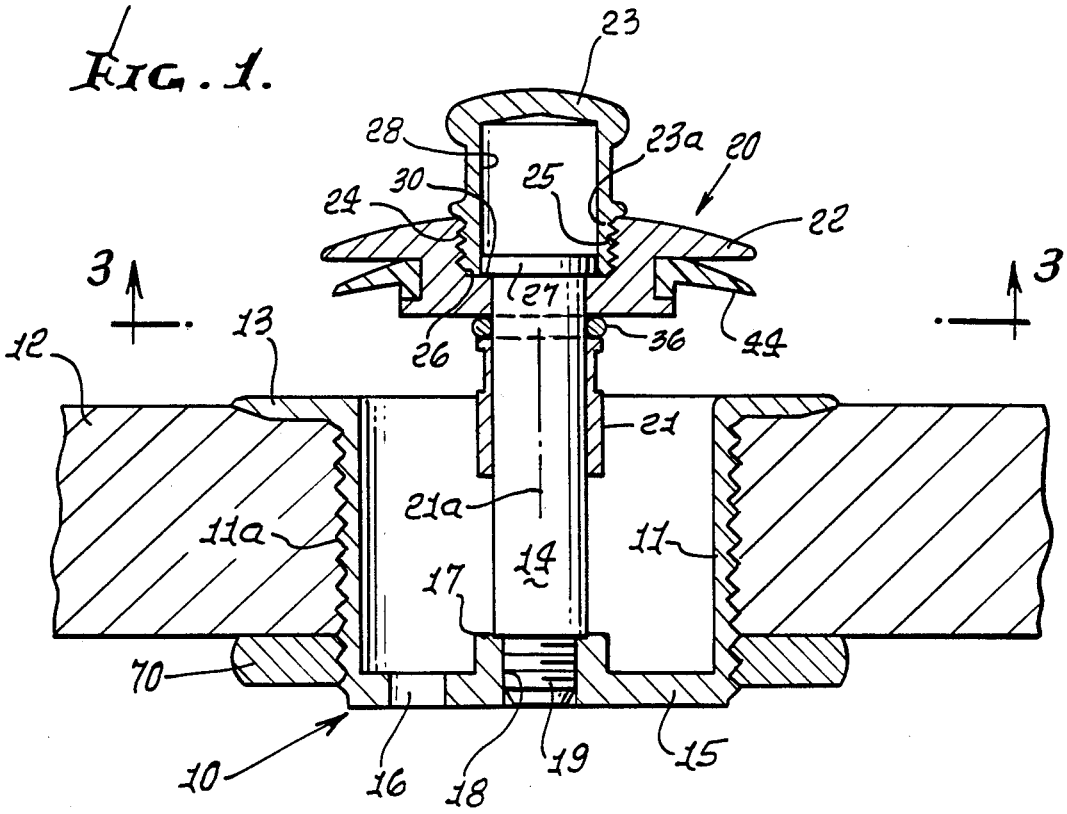
FIG. 1 is a section in elevation, showing the drain closure of the invention, in open position.

In the drawings, a drain body 10 has an upright cylindrical wall 11 sized to fit in retainer structure, indicated at 12. A top flange 13 integral with wall 11 fits over structure 12, as shown. A nut 70 is received on body wall thread **11*a* to retain the body to 12**.

An upright post 14 projects axially centrally upwardly within the body 10 interior, and may be carried by body ribs 15 which are spaced apart to form multiple drain openings 16. A central support 17 integral with the ribs may be threaded at 18 to receive the lower threaded end 19 of the post. The post 14 typically projects upwardly above the level of the flange 13.

A stopper 20 has a downwardly projecting sleeve 21, a closure 22 integral with and above the shaft, and a cap 23. The cap has a tubular skirt **23*a*, the lower extent of which is externally threaded at 24, and has threaded interfit with internal thread 25 in a recess 26 formed in the closure. A flange 27 on the top of the post 14 is received in the bore 28 of the cap, and serves to limit upward movement of the closure 22 on the post 14. Downward movement of the closure 22 is limited by sealing engagement of annular seal 44 on flange 13. Thus, in FIG. 1, the flange 27 engages a stepped wall 30 on the closure, and in FIG. 2, the flange clears (stops short of) the inner wall 31 of the cap. A circumferential ridge 23*b* limits downward threading of skirt 23*a* into the thread 25 of recess 26. Wall 31 in the cap allows the flange 27 on the post 14** to freely move up and down.

Figure 3:
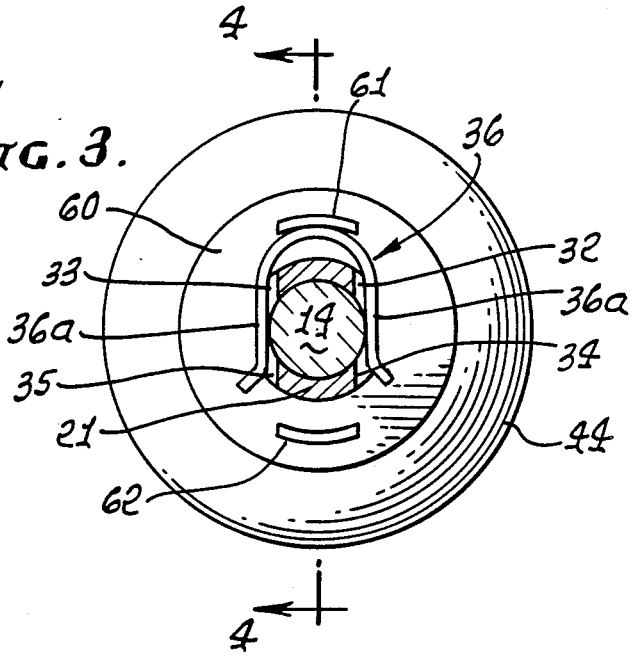
FIG. 3 is a section taken on lines 3—3 of FIG. 1.
Figure 4:
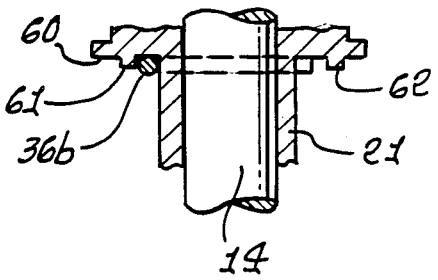
FIG. 4 is a section on lines 4—4 of FIG. 3.
Figure 5:
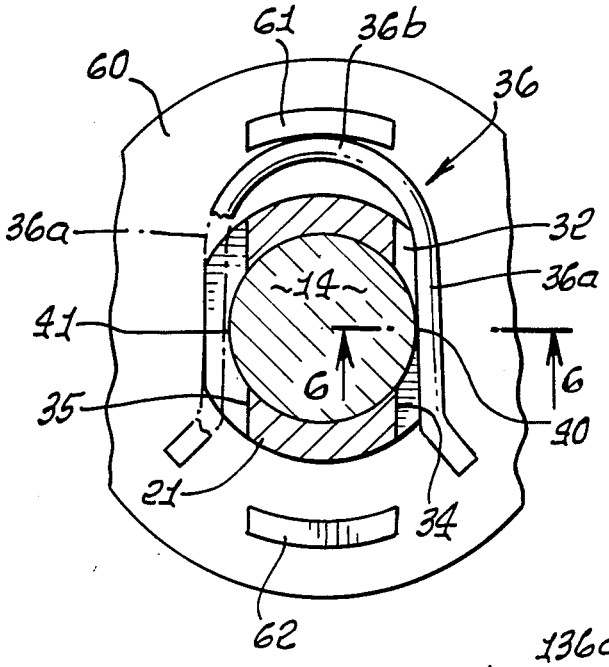
FIG. 5 is an enlarged view, like FIG. 3.
Figure 6:
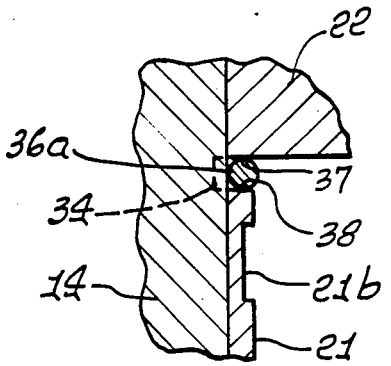
FIG. 6 is a section on lines 6—6 of FIG. 5.

The metallic sleeve 21 has two local openings therethrough, and at opposite sides of sleeve axis **21*a*. Those openings appear at 32 and 33 in FIG. 3. The shaft walls, adjacent to the openings are cut away to form parallel flats 34 and 35 in axial planes intersecting the post and parallel to axis 21*a* so that the post effectively protrudes radially into the openings, to limited extent, as seen in FIGS. 4 and 5**. The openings may be alike, and sector shaped.

Figure 2:
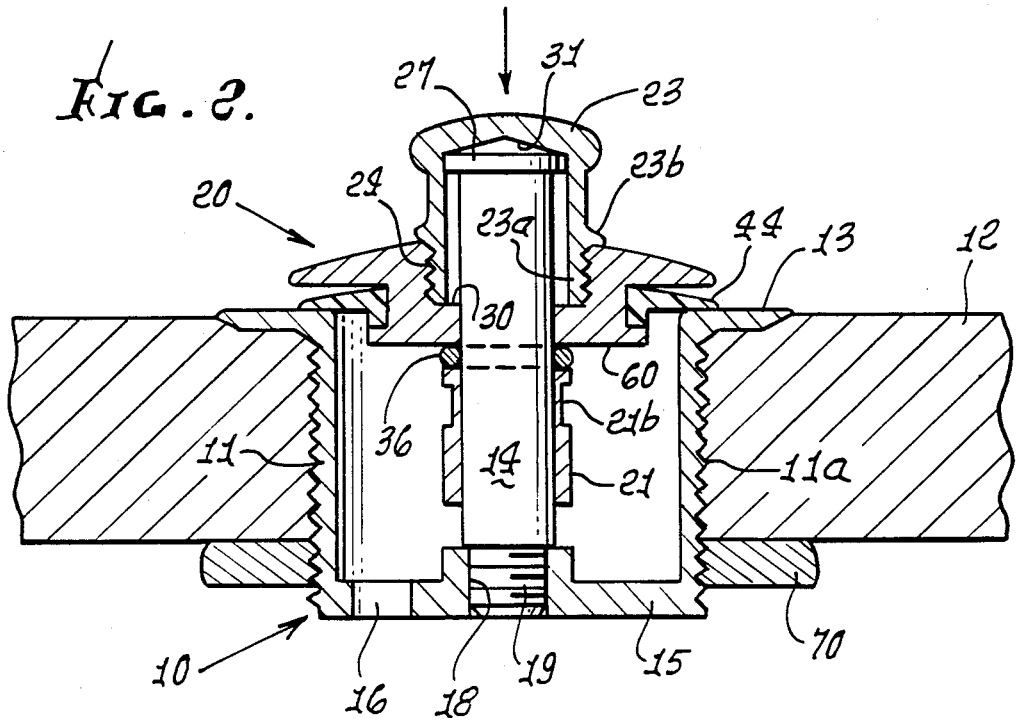
FIG. 2 is a view like FIG. 1 showing the drain closure in closed position.

A U-shaped metallic spring 36 is carried by the sleeve 21 and has generally parallel arms **36*a* that are received in the openings 32 and 33, between axially oppositely facing walls 37 and 38 thereof, whereby the arms are axially retained by the sleeve, but the arms are free to flex toward and away from axis 21*a*. Normally, the arms are slightly spaced from flats 34 and 35. Arms 36*a* are connected by turn 36*b*, located outwardly of the sleeve 21, as best seen in FIGS. 3 and 5. The arms frictionally grip or engage opposed outer surface portions of the post 14, as at 40 and 41. Accordingly, the sleeve 21, spring and closure are adjustably movable up and down relative to the post, against frictional force exerted by the spring arms gripping the post, as the arms slide relative to the gripped post. Also, the frictional gripping action holds the closure in any selected position into which it is moved, as for example the fully open and fully closed positions of FIGS. 1 and 2, respectively. An annular seal 44 may be carried by the closure to project outwardly for sealing engagement with the flange 13, as seen in FIG. 2**.

Rotation of cap 23 when a wrench is held in engagement with the wrench flats **21*b*, permits grasping of the post 14, so that it can be rotated to enable its removal from threaded connection at 18**. This then facilitates quick disassembly and replacement.

Spring bend 36b is located adjacent the horizontal underside 60 of the stopper, for flatly positioning the spring and arms, horizontally. Captivation of the spring turn is provided by arcuate bosses 61 or 62, as seen in FIGS. 3 and 4. Bosses 61 and 62 are typically machined from a turned blank, in two passes of a stepped milling cutter, simultaneously creating the bosses 61 and 62, the two wrench flats and the two openings 32 and 33. The U-shaped spring is easily inserted and removed, as by use of a nail, no tools being required.

Additional advantages include low manufacturing cost, no requirement for close tolerances, and the capability for one milling machine set up to produce slots, wrench flats, and arcuate bosses.

Figure 7:
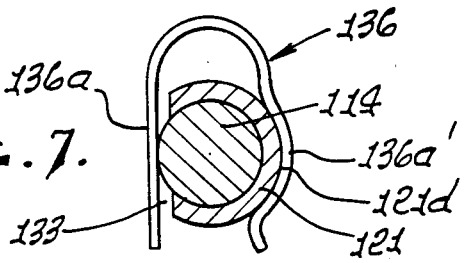
FIG. 7 is a view like FIG. 5, but showing a modification.

In FIG. 7, the structure is the same as in FIGS. 3 & 5, except that the sleeve 121 (corresponding to sleeve 21) has only one slot or opening 133 (corresponding to opening 33 in FIG. 3) to receive one arm 136a of the U-shaped spring 136. The other arm 136a' is arcuately shaped to fit against the outer side 121d of the sleeve 121, as shown. Thus, only one spring arm 136a frictionally engages the side of the post 114, and the arcuate portion of arm 136a' releasably engages the sleeve 121 to hold the spring in position on the sleeve 121.

We claim:

1. In a drain closure, the combination comprising:

(a) a drain stopper having a downwardly projecting sleeve, (b) an upwardly extending post loosely received in said sleeve, and means carrying the post, (c) the sleeve having at least one opening through the side thereof, (d) and a spring carried by the sleeve and having an arm received in said opening to frictionally engage the post, (e) whereby the sleeve, spring and stopper are adjustably movable up and down relative to the post, against frictional force exerted by the spring arm engaging the post as the arm slides relative to the post.

2. The closure of claim 2 wherein the post locally projects into said opening, to be engaged by the arm.

3. The closure of claim 2 wherein the sleeve defines upper and lower walls between which the spring arm is confined, at said opening.

4. The closure of claim 2 wherein the sleeve defines flats facing but spaced from the arm, the flats extending in planes parallel to an axis defined by the post.

5. The closure of claim 1 wherein said means includes a tubular drain body, which opens upwardly, the post projecting above said body, the post and body being coaxial.

6. The closure of claim 5 wherein the stopper has a removable tubular cap, and the post projects into said cap when the stopper is closed downwardly, relative to said body.

7. The closure of claim 6 including a flange at the upper end of the post, the flange and stopper having interengagement to limit upward movement of the stopper relative to said body.

8. The closure of claim 6 wherein the post lower end has removable threaded connection with said tubular drain body. structure.

9. The closure of claim 7 wherein the cap has a bore within which said flange is slidably received.

10. The closure of claim 5 wherein the spring is U-shaped and has two arms, and a turn integral with said arms and located adjacent an underside defined by the stopper, and radially outwardly spaced from the sleeve.

11. The closure of claim 10 including boss structure on the stopper captivating the spring turn.

12. The closure of claim 1 wherein the spring is U-shaped and has two of said arms, the sleeve having two of said openings receiving the two spring arms which frictionally engage opposite sides of the post.

13. The closure of claim 1 wherein the spring is U-shaped and has a second arm engaging the outer side of the sleeve.

* * * * *